US009730474B2

(12) United States Patent
Lieberman

(10) Patent No.: US 9,730,474 B2
(45) Date of Patent: Aug. 15, 2017

(54) SKI SOCK

(76) Inventor: Barnet L. Lieberman, New York, NY (US)

( * ) Notice: Subject to any disclaimer, the term of this patent is extended or adjusted under 35 U.S.C. 154(b) by 1723 days.

(21) Appl. No.: 11/904,230

(22) Filed: Sep. 26, 2007

(65) Prior Publication Data

US 2008/0022440 A1 Jan. 31, 2008

Related U.S. Application Data

(63) Continuation-in-part of application No. 11/095,366, filed on Mar. 31, 2005, now abandoned.

(51) Int. Cl.
*A43B 17/00* (2006.01)
*A41B 11/00* (2006.01)

(52) U.S. Cl.
CPC ..... *A41B 11/005* (2013.01); *A41B 11/00* (2013.01)

(58) Field of Classification Search
USPC ..... 2/239, 240, 241, 242; 66/178 R, 179, 66/182, 183, 184, 185, 186, 187, 188, 66/178 A
See application file for complete search history.

(56) References Cited

U.S. PATENT DOCUMENTS 67,264 A * 7/1867 Carey ..... 66/187
832,550 A * 10/1906 Lepper ..... 2/61
1,216,374 A * 2/1917 Smith ..... 66/187
1,330,315 A * 2/1920 Hagan ..... 2/239
1,476,043 A * 12/1923 Bosworth ..... 66/179
1,543,353 A 6/1925 Wolff
1,936,038 A * 11/1933 Schindler ..... 66/185
2,018,248 A * 10/1935 Borner ..... 66/187
2,102,368 A * 12/1937 Martel ..... 66/182
2,130,018 A * 9/1938 Lochhead ..... 66/185
2,144,563 A * 1/1939 Davis ..... 66/182
2,223,102 A * 11/1940 Grosse ..... 66/182
2,429,625 A 10/1947 Horn
2,790,975 A * 5/1957 McCormick ..... 2/239
2,909,854 A * 10/1959 Edelstein ..... 36/140
3,217,336 A * 11/1965 Wikler ..... 2/239
3,298,205 A * 1/1967 Reymes-Cole ..... 66/185
3,329,972 A * 7/1967 Schwab et al. ..... 2/239
3,905,212 A * 9/1975 Bounous et al. ..... 66/185
4,069,515 A * 1/1978 Swallow et al. ..... 2/239
4,253,317 A 3/1981 Howard et al.
4,255,949 A 3/1981 Thorneburg
4,277,959 A 7/1981 Thorneburg
4,341,097 A * 7/1982 Cassidy et al. ..... 66/187
4,597,195 A * 7/1986 Dananberg ..... 36/28
4,608,988 A * 9/1986 Dananberg ..... 36/140
4,651,354 A 3/1987 Petrey
5,054,129 A * 10/1991 Baehr ..... 2/409
(Continued)

FOREIGN PATENT DOCUMENTS

CH 635234 A 3/1983

*Primary Examiner* — Alissa L Hoey
(74) *Attorney, Agent, or Firm* — Cozen O'Connor

(57) ABSTRACT

A sock has a leg portion, a heel portion, an instep portion, a toe portion, and a pair of lateral metatarsal joint portions where the instep portion meets the toe portion. The sock has a first material thickness at the instep portion and the toe portion, and a second material thickness at at least one of the lateral metatarsal joint portions, wherein the second material thickness is less than the first material thickness.

15 Claims, 2 Drawing Sheets

(56) References Cited

U.S. PATENT DOCUMENTS

| | | | | |
|---|---|---|---|---|
| 5,412,957 | A | 5/1995 | Bradberry et al. | |
| 5,590,420 | A * | 1/1997 | Gunn | 2/69 |
| 5,603,232 | A | 2/1997 | Throneburg | |
| 5,617,745 | A * | 4/1997 | Della Corte et al. | 66/178 A |
| 5,752,278 | A | 5/1998 | Gunn | |
| 5,768,803 | A * | 6/1998 | Levy | 36/43 |
| 5,771,495 | A | 6/1998 | Turner et al. | |
| 5,784,721 | A * | 7/1998 | Huff | 2/239 |
| 5,792,093 | A * | 8/1998 | Tanaka | 602/63 |
| 5,829,057 | A | 11/1998 | Gunn | |
| 5,898,948 | A * | 5/1999 | Kelly et al. | 2/240 |
| 6,021,527 | A | 2/2000 | Lessard | |
| 6,131,311 | A * | 10/2000 | Brown et al. | 36/43 |
| 6,182,380 | B1 * | 2/2001 | Liley | 36/71 |
| 6,286,151 | B1 | 9/2001 | Lambertz | |
| 6,318,373 | B1 * | 11/2001 | Kasahara | 128/894 |
| 6,341,505 | B1 | 1/2002 | Dahlgren | |
| 6,381,756 | B1 | 5/2002 | Smith | |
| 6,446,267 | B1 * | 9/2002 | Shah | 2/239 |
| 6,665,883 | B2 | 12/2003 | Sloan | |
| 6,708,348 | B1 | 3/2004 | Romay | |
| 6,735,988 | B1 | 5/2004 | Honeycutt | |
| 6,766,539 | B1 * | 7/2004 | Huber | 2/239 |
| 6,805,681 | B2 | 10/2004 | Yokoyama | |
| RE40,363 | E * | 6/2008 | Grim et al. | 36/88 |
| 2001/0027665 | A1 | 10/2001 | Fujimoto | |
| 2002/0095716 | A1 | 7/2002 | Solwey | |
| 2002/0108166 | A1 * | 8/2002 | Abboud | 2/239 |
| 2003/0074718 | A1 * | 4/2003 | English | 2/239 |
| 2005/0155137 | A1 * | 7/2005 | Berger | 2/239 |
| 2006/0130217 | A1 | 6/2006 | Lambertz | |
| 2006/0218973 | A1 * | 10/2006 | Kim et al. | 66/178 R |
| 2007/0180598 | A1 * | 8/2007 | Collins | 2/239 |
| 2008/0034479 | A1 * | 2/2008 | Barnett | 2/241 |
| 2008/0041113 | A1 * | 2/2008 | Mori et al. | 66/54 |
| 2009/0165190 | A1 * | 7/2009 | Araki et al. | 2/240 |

* cited by examiner

SKI SOCK

CROSS REFERENCE TO RELATED APPLICATIONS

This application is a continuation-in-part of U.S. patent application Ser. No. 11/095,366 which was filed with the U.S. Patent and Trademark Office on Mar. 31, 2005 now abandoned.

BACKGROUND OF THE INVENTION

1. Field of the Invention

The invention relates to an athletic or sports sock, especially a ski sock, having a non-uniform thickness in different portions of the sock.

2. Description of the Related Art

Athletic socks having different thicknesses in different portions of the sock are well known. U.S. Pat. No. 4,253,317 discloses a typical such sock wherein the sock is knitted to be thicker at the toe, the heel, and the top portions than in the instep. U.S. Pat. No. 6,021,527 discloses an anatomically designed sock, in particular an asymmetric ski sock, having variably thickened fabric areas at the heel, arch, ball, and toe portions of the sock. U.S. Pat. No. 5,771,495 discloses a snowboarding sock having the highest density at the heel, a medium density on the instep, and the lowest density at the toes, in order to give a good feel of the snowboard and thereby improve control.

All of the socks mentioned in the prior art are for people with normal feet, and do not recognize the problems faced by a person having a foot which is wider than normal in the area of the metatarsal joints. As used herein, the term metatarsal joint refers to the joint between the metatarsal bones and the phalanges, the lateral metatarsal joint portions being located on the lateral sides of the foot where the foot is widest. These lateral portions of the foot can press hard against the sides of an otherwise properly fitting boot such as a ski boot, thereby causing pain and numbness. While boots can be made with custom molded linings, this does not solve the problem for a person who is renting standard ski boots or other stiff athletic footwear such as ice skates or in-line skates. What is needed is an on-the-spot adapting mechanism for eliminating discomfort to the wearer.

SUMMARY OF THE INVENTION

The invention applies to a sock having a leg portion, a heel portion, an instep portion, a toe portion, and a pair of lateral metatarsal joint portions where the instep portion meets the toe portion. Each of the metatarsal joint portions covers a corresponding metatarsal joint of a foot, and is limited to an area immediately surrounding the joint, when the sock is worn. The sock has a first material thickness at the instep portion and the toe portion, and a second material thickness at at least one of the lateral metatarsal joint portions, wherein the second material thickness is less than the first material thickness. The second material thickness is confined to the at least one metatarsal joint portion. This construction provides relief of pressure on the adjacent lateral metatarsal joint portion of the foot. Since the metatarsal joints frequently protrude on both sides of the foot, the sock is preferably constructed with a lesser thickness at both lateral metatarsal joint portions, and is preferably asymmetric.

The sock according to the invention may be constructed according to a number of methods, in particular by an automated knitting procedure which reduces the number of yarns at the lateral metatarsal joint portions. Alternatively, the sock may be a composite sock constructed as a liner which is fitted into an outer sock having holes at the lateral metatarsal joint portions.

The advantage of the sock is that it can be made available in a ski rental shop to a customer with unusually wide metatarsal joints, thereby saving that customer from a day of pain and cold caused by numbness in a tight boot. Once purchased, the customer can reuse the socks whenever confronted with standard ill-fitting rental footwear, though typically he will end up buying another pair of socks.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
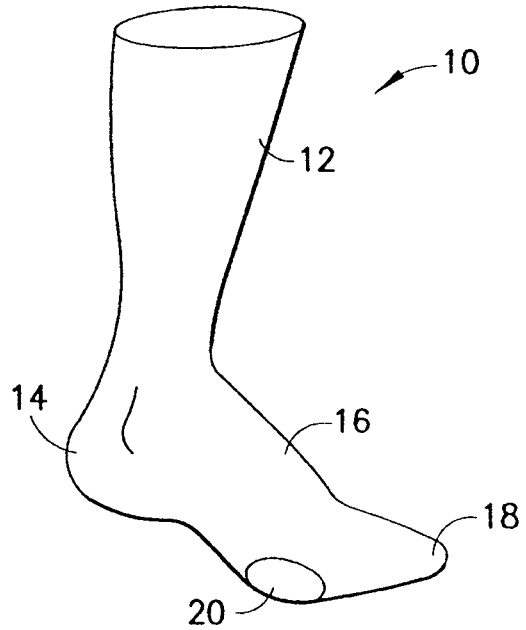
FIG. 1 is a perspective of a right sock according to the invention.

Referring to FIG. 1, the sport sock 10 according to the invention includes a leg portion 12, a heel portion 14, an instep portion 16, a toe portion 18, and a lateral metatarsal joint portion 20 where the instep portion 16 meets the toe portion 18. This being a perspective view of a sock 10 for the right foot, only a first or outside lateral metatarsal joint portion 20 is visible. A second, inside lateral metatarsal joint portion is not visible.

Figure 2:
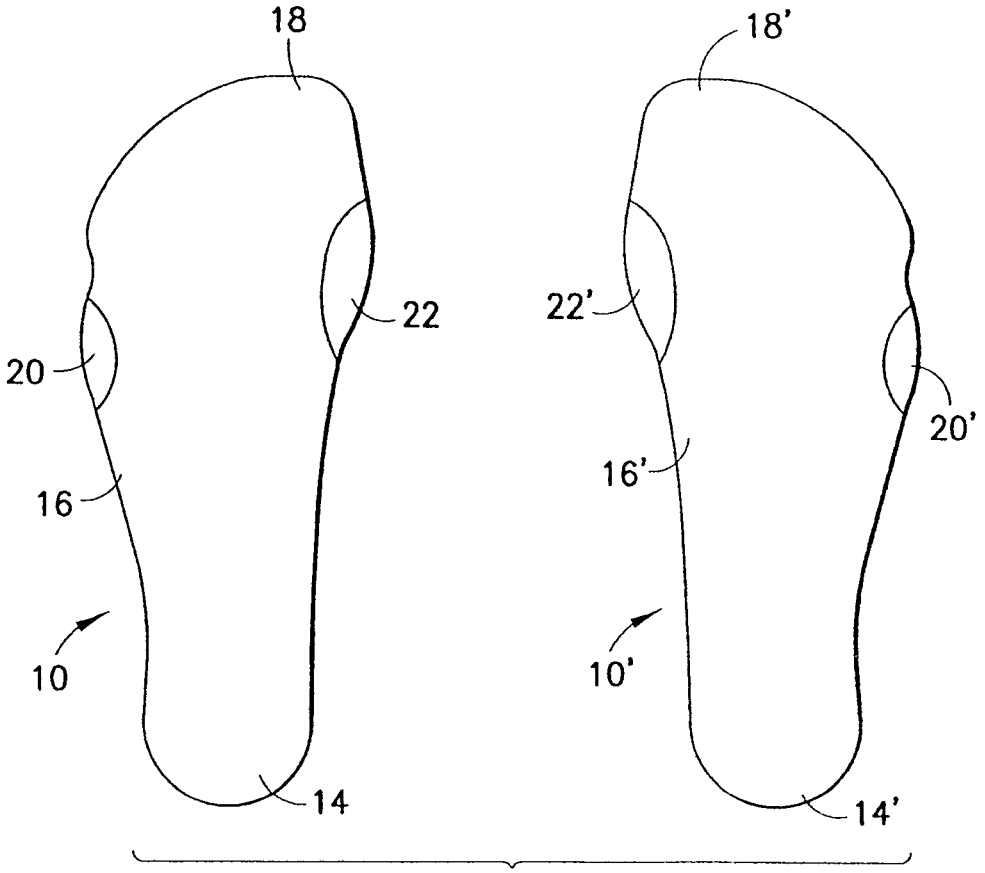
FIG. 2 is a bottom view of a pair of socks.

FIG. 2 is a bottom view of a pair of socks which each have a first metatarsal joint portion 20, 20' and a second metatarsal joint portion 22, 22'. The socks are each designed asymmetrically, the sock 10 being adapted for the right foot, the sock 10' being adapted for the left foot. It is also possible to have a universal design, i.e. a symmetric sock, although the match of the metatarsal joint portions to the metatarsal joints of the foot would be less precise.

The sock according to the invention is constructed with a first material thickness at the instep portion 16 and the toe portion 18, and a second material thickness at at least one of the lateral metatarsal joint portions 20, 22. This is achieved by providing a knit with a different thickness at the metatarsal joint portion 20 and or 22, for example by knitting with multiple yarns to achieve the first material thickness, and omitting one of the yarns to achieve the second material thickness. Methods for varying the yarn content to selectively vary the thickness are disclosed, inter alia, in U.S. Pat. Nos. 4,253,317 and 6,021,527.

Another method would be to take a relatively thick sock and cut out holes at at least one of the lateral metatarsal joint portions, then to sew in a piece of thinner material over each hole. This method is more labor intensive than providing the varying thicknesses using an automated knitted process, but more well suited to a custom made sock.

The sock according to the invention may have yet a third material thickness to provide additional cushioning at the heel portion, as is well known.

Figure 3:
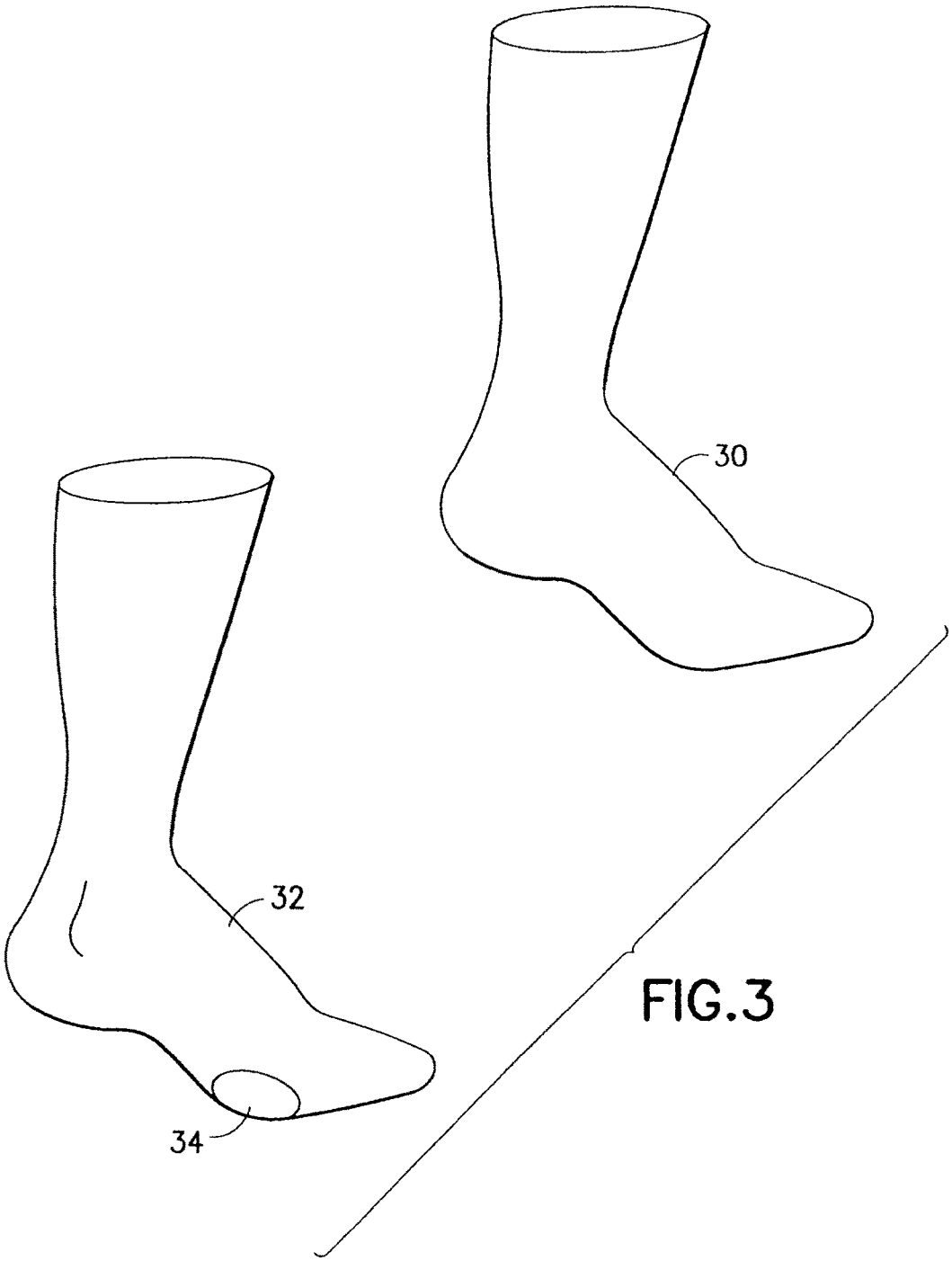
FIG. 3 is an exploded perspective of a composite sock.

Another embodiment is depicted in FIG. 3, which depicts a liner sock part 30 and an outer sock part 32 provided with at least one hole 34 corresponding to a lateral metatarsal joint portion. The liner sock part 30 is received in the outer sock part 32 to form a composite sock wherein the liner sock 32 is visible through the hole 34 at the first lateral metatarsal joint portion 20 (FIG. 1). In order to be hydrophobic, the liner sock is preferably made from a synthetic material such as nylon, whereas the outer socket may be made of a blend of wool and silk in order to draw perspiration away from the foot. The two parts may or may not be joined together by sewing, adhesive bonding, or other joining means.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A sock comprising a leg portion, a heel portion, an instep portion, a toe portion, and a pair of lateral metatarsal joint portions where the instep portion meets the toe portion, each said metatarsal joint portion covering a corresponding metatarsal joint of a foot, and being limited to an area immediately surrounding said joint, when the sock is worn, wherein the sock has a first material thickness at the instep portion and the toe portion, and a second material thickness at at least one of said lateral metatarsal joint portions, wherein the second material thickness is less than the first material thickness, and wherein the second material thickness is confined to said at least one metatarsal joint portion.

2. The sock of claim 1, wherein the sock has said second material thickness at only one of said lateral metatarsal joint portions.

3. The sock of claim 2, wherein the sock is designed for a left foot.

4. The sock of claim 1, wherein the sock has said second material thickness at both of said lateral metatarsal joint portions.

5. The sock of claim 4, wherein the sock is symmetrically designed for either a left foot or a right foot.

6. The sock of claim 4, wherein the sock is asymmetrically designed for one of a left foot and a right foot.

7. The sock of claim 6, wherein the sock is designed for left foot.

8. A sock as recited in claim 1, wherein said sock is a composite sock comprising a liner sock part and an outer sock part, one of said sock parts having a uniform thickness, the other of said sock parts having a hole at at least one of said lateral metatarsal joint portions.

9. The sock of claim 8, wherein the outer sock part has said hole.

10. The sock of claim 8, wherein said liner sock part is made of synthetic material.

11. The sock of claim 10, wherein the liner sock part is made of nylon.

12. The sock of claim 1, wherein the sock is woven to form said first material thickness and said second material thickness.

13. The sock of claim 1, wherein the sock is made of a first material having said first material thickness, provided with a hole at at least one of said lateral metatarsal joint portions, and provided with a patch of material having said second material thickness in each said hole.

14. The sock of claim 2, wherein the sock is designed for a right foot.

15. The sock of claim 6, wherein the sock is designed for the right foot.

* * * * *